US006244503B1

(12) United States Patent
Miller et al.

(10) Patent No.: US 6,244,503 B1
(45) **Date of Patent: *Jun. 12, 2001**

(54) CONTAINER CLOSURE APPARATUS

(75) Inventors: C. Daniel Miller, Rockford, IL (US); Arthur W. Robichaud, West Worthington; Michael G. Tokarski, Dublin, both of OH (US)

(73) Assignee: SIG Combibloc Inc., Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/449,595

(22) Filed: Nov. 29, 1999

Related U.S. Application Data

(63) Continuation of application No. 09/093,147, filed on Jun. 8, 1998, now Pat. No. 5,992,734, which is a continuation of application No. 08/792,926, filed on Jan. 21, 1997, now Pat. No. 5,823,420, which is a continuation of application No. 08/521,745, filed on Aug. 31, 1995, now Pat. No. 5,639,018.

(51) Int. Cl.[7] ..... B65D 5/74

(52) U.S. Cl. ..... 229/125.15; 220/254; 220/838; 220/839; 229/125.04; 229/125.14

(58) Field of Search ..... 229/125.04, 125.09, 229/125.14, 125.15, 930, 931; 220/254, 256, 258, 366.1, 367.1, 838, 839

(56) References Cited

U.S. PATENT DOCUMENTS

| | | | | |
|---|---|---|---|---|
| 3,526,566 | * | 9/1970 | McIlvain et al. | 229/930 |
| 3,629,901 | * | 12/1971 | Wolf et al. | 229/930 |
| 3,998,354 | * | 12/1976 | Song | 220/254 |
| 4,778,071 | * | 10/1988 | Fillmore | 220/838 |
| 4,930,683 | * | 6/1990 | Farber | 229/125.15 |
| 5,016,777 | * | 5/1991 | Marvin | 220/839 |
| 5,101,999 | * | 4/1992 | Robichaud et al. | 229/125.14 |
| 5,126,093 | * | 6/1992 | Gelardi et al. | 220/839 |
| 5,639,018 | * | 6/1997 | Tokarski et al. | 229/125.04 |
| 5,823,420 | * | 10/1998 | Tokarski et al. | 229/120.04 |
| 5,992,734 | * | 11/1999 | Tokarski et al. | 229/125.04 |

FOREIGN PATENT DOCUMENTS

| | | | | |
|---|---|---|---|---|
| 577865 | * | 1/1994 | (EP) | 229/125.15 |
| 242753 | * | 9/1990 | (JP) | 220/839 |

* cited by examiner

*Primary Examiner*—Gary E. Elkins
(74) *Attorney, Agent, or Firm*—Standley & Gilcrest LLP

(57) ABSTRACT

The present invention is a package closure apparatus. The landing extends from a base of the closure apparatus into an opening of the closure apparatus. The spring face adjoins the landing at a first junction forming a first flexible joint. The push-tab adjoins the spring face at a second junction forming a second flexible joint. The first flexible joint, the spring face, and the second flexible joint cooperate to enable the push-tab to move relative to the base of the apparatus. The air vent is adapted to facilitate a substantially even flow rate of a product through the opening of the closure apparatus.

19 Claims, 3 Drawing Sheets

CONTAINER CLOSURE APPARATUS

CROSS-REFERENCE TO RELATED APPLICATIONS

This application is a continuation of U.S. application Ser. No. 09/093,147, filed Jun. 8, 1998, now U.S. Pat. No. 5,992,734, which is a continuation of U.S. application Ser. No. 08/792,926, filed Jan. 21, 1997, now U.S. Pat. No. 5,823,420, which is a continuation of U.S. application Ser. No. 08/521,745, filed Aug. 31, 1995, now U.S. Pat. No. 5,639,018.

BACKGROUND AND SUMMARY OF THE INVENTION

The present invention relates generally to containers useful for products that may be poured from the container and, more particularly, to improved closures secured to said containers. For example, paperboard cartons are generally well known. A familiar type is the milk carton, which has a gabled top. Also, becoming ever more popular are rectangular shaped cartons, some of aseptic quality, for containing beverages, powdered goods, and practically any other pourable substance. To prevent waste and provide for ease of pouring, improved pour-through closure apparatus for securing openings in said containers are needed. Practically any container to be used to hold pourable contents may benefit from the improved closure of the present invention.

Push-tabs have been used in combination with container closure apparatus, which are designed to be depressed into the material of the container or package. The push-tabs serve to open a partially pre-cut area on the surface of the package below the closure. The push-tab separates the material of the package and may serve to hold the material apart to maintain the opening during pouring.

Previous closure push-tabs have been hinged directly to an inner wall that defined a central opening in the closure apparatus. The present invention recognizes a need for improved force distribution through the hinge, when the push-tab is depressed by a user of the container. By improving the push-tab hinge design, stress distribution through the hinge is improved. As a result of the hinge design improvements, the closure apparatus may be manufactured from a broader range of materials, some of which may be less expensive.

The present invention provides a push-tab hinge that distributes stresses more effectively than previous hinge designs. In particular, the present invention provides a landing that extends from the closure opening to a spring face, which depends from the push-tab. The junction between the landing and the spring face provides a first flexible joint through which the hinge acts. The junction between the spring face and the push-tab provides a second flexible joint through which the hinge acts. Furthermore, an air vent in the hinge is adapted to facilitate a substantially even flow rate of a product through the closure opening.

The entire apparatus may be made as a one-piece injection molded plastic unit, having movable parts, which requires no assembly. Reference is made to U.S. Pat. No. 5,101,999, which is hereby incorporated by reference into the present application.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
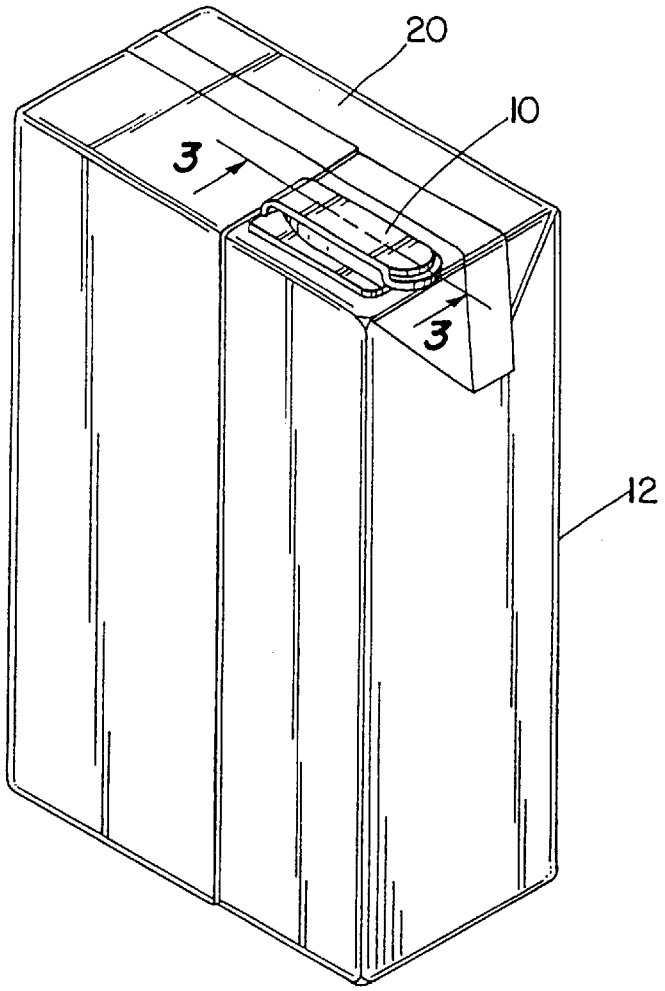
FIG. 1 is a perspective view of one embodiment of the closure apparatus of the present invention attached to the top of a package or container.

Referring to FIG. 1, a closure apparatus 10 for opening and resealing a package 12 is shown. The package 12 may be made from a penetrable material, and may contain a dispensable fluid, powder, particulate solid substance, or any other pourable contents.

Figure 2:
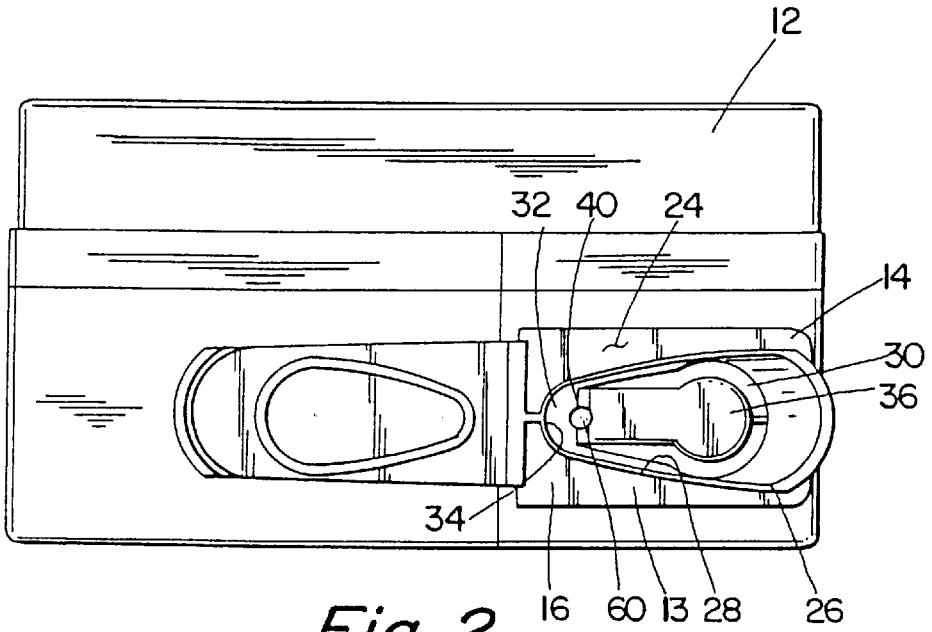
FIG. 2 is a plan view of the closure apparatus of FIG. 1 with a cover rotated to its open position.
Figure 3:
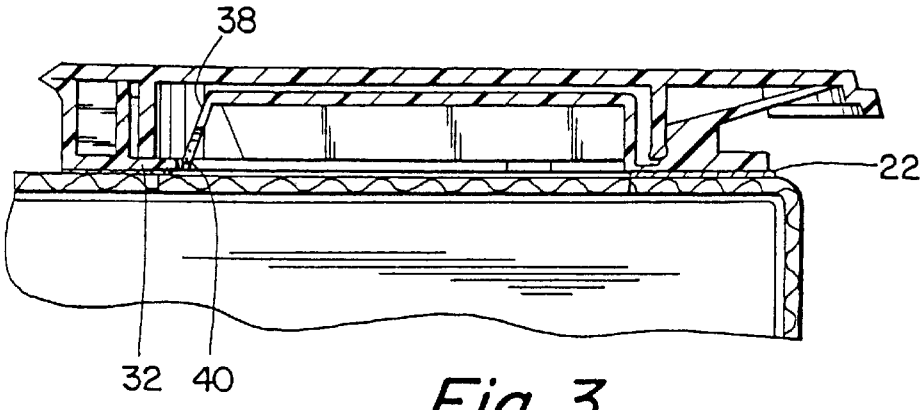
FIG. 3 is an enlarged section view taken along line 3—3 in FIG. 1.
Figure 5:
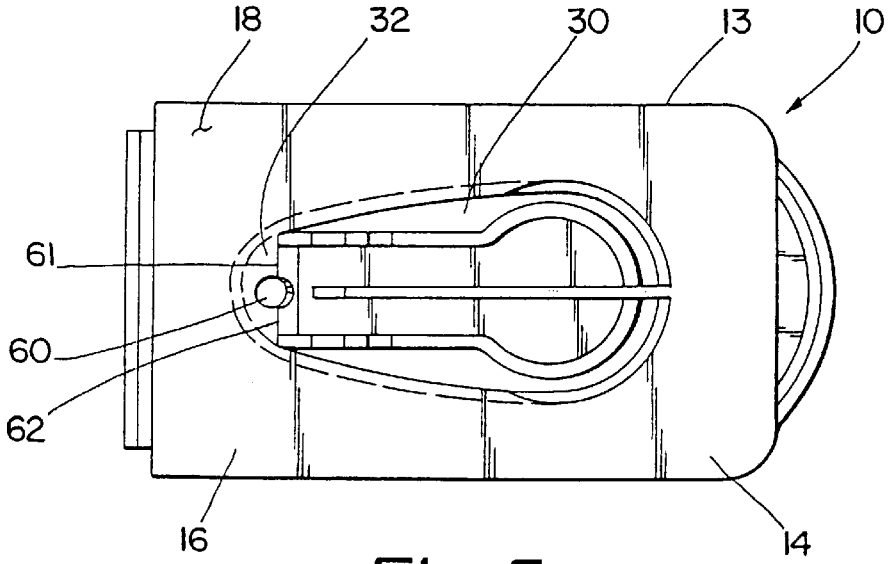
FIG. 5 is a plan view showing the bottom surface of a preferred embodiment of the closure apparatus of the present invention.

As shown in FIG. 2, the closure apparatus 10 may have a base 13 having a forward portion 14 and a rearward portion 16. The bottom surface 18 of the base 13 (as shown in FIG. 5) may be attached to the package top 20 by any suitable means, such as an adhesive 22 applied to the bottom surface 18. The closure apparatus is shown secured to the package 12 in FIG. 3.

On a top surface 24 of the base 13 there may be a formed pour wall 26. Interiorally of the pour wall 26 there may be formed an inner side wall 28 that defines an opening 30. In the preferred embodiment, a landing 32 extends from the rear portion 34 of the inner side wall 28. It is to be recognized that the landing 32 may extend from elsewhere, such as from pour wall 26, on the apparatus 10 and remain within the scope of the present invention. The present invention may also be accomplished without a landing.

Figure 6:
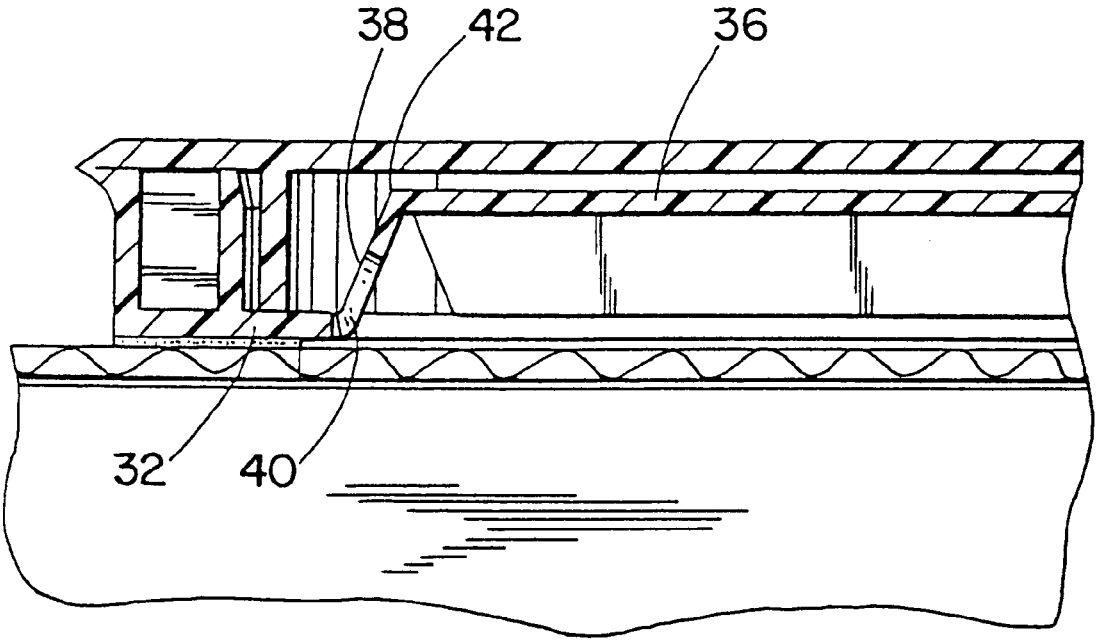
FIG. 6 is a detail view of the hinge of FIG. 3.

A push-tab 36 is formed to initially reside within the inner side wall 28 directly over the opening 30. The push-tab 36 has a spring face (best shown in FIG. 3) extending from the push-tab 36. The spring face 38 is also integrally connected with the landing 32. The junction 40 between the spring face 38 and the landing 32 forms a first flexible joint. The junction 42 between the spring face 38 and the push-tab 36 forms a second flexible joint. Both flexible joints 40, 42 may be seen best in FIG. 6. The spring face 38 and the first and second junctions 40 and 42 in combination with the landing 32 provides a robust hinge which distributes stress more effectively than previous designs.

The spring face 38 may, in another embodiment of the present invention, extend directly from the inner side wall 28. In this case, the first junction 40 would reside at the location where the side wall 28 and the spring face 38 meet.

Figure 4:
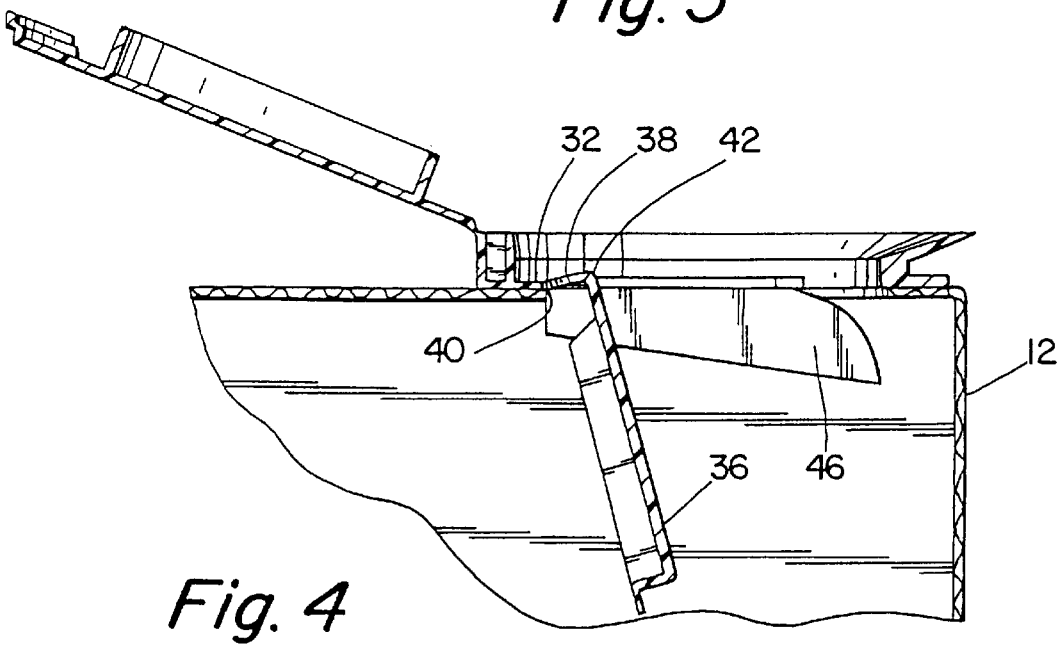
FIG. 4 is a cut away, side elevation view showing the push-tab in its open position and material of the package top broken into the package.

Referring to FIG. 4, the push-tab 36 is shown in its depressed position, having broken through the material 46 of the package 12. As the push-tab 36 is depressed, junctions 40 and 42 are placed in flexion, as is spring face 38.

The closure apparatus 10 may be provided with a vent hole 60 to allow air to enter and exit the package when the contents are poured from the package 12. The vent hole 60 allows for a more even flow rate of the contents out of the package. Vent hole 60 may be provided in several places, including in spring face 38, in landing 32, and/or in push-tab 36. In addition, the vent hole 60 may straddle the junction 40 and/or the junction 42. It should be recognized that the hinge may have more than one vent hole 60.

Referring to FIG. 5, if the vent hole 60 is supplied where shown, in the center of junction 40, it effectively divides the junction into two halves. The two halves 61, 62 act as hinge straps. The dual hinge strap embodiment results in practically having two junction hinges (61 and 62) in place of one continuous junction hinge 40.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A package closure apparatus comprising a base portion, said base portion having an opening through which contents of a package may be dispensed, said apparatus comprising:

a spring face connected to said base portion;

a tab portion secured to said base portion by said spring face, said tab portion adapted to be rotated through said opening and said package to open said package, said spring face adapted to flex as said tab portion is rotated through said package; and a lid portion pivotally secured to said base portion, said lid portion movable to a position over said opening in said base portion thereby closing said opening.

2. The package closure apparatus of claim 1 wherein said spring face, lid portion, said base portion, and said tab portion are formed from one piece of material in an injection molding process.

3. The package closure apparatus of claim 1 wherein said spring face is connected to said base portion by a first flexible joint.

4. The package closure apparatus of claim 1 wherein said tab portion is connected to said spring face by a second flexible joint.

5. The package closure apparatus of claim 1 wherein:

said spring face is connected to said base portion by a first flexible joint; and said tab portion is connected to said spring face by a second flexible joint.

6. The package closure apparatus of claim 1 further comprising an air vent.

7. A package opening device comprising:

a base portion defining an opening;

a spring face connected to said base portion; and a tab portion connected to said base portion by said spring face, said tab portion adapted to be rotated through said opening, said spring face adapted to flex as said tab portion is rotated through said opening.

8. The package opening device of claim 7 wherein said spring face, said base portion, and said tab portion are integrally formed.

9. The package opening device of claim 7 wherein said spring face is connected to said base portion by a first flexible joint.

10. The package opening device of claim 7 wherein said tab portion is connected to said spring face by a second flexible joint.

11. The package opening device of claim 7 wherein:

said spring face is connected to said base portion by a first flexible joint; and said tab portion is connected to said spring face by a second flexible joint.

12. The package opening device of claim 7 further comprising an air vent.

13. A package opening device comprising:

a base portion having an opening and a landing adjacent said opening;

a tab portion adapted to be rotated through said opening; and a spring face connecting said tab portion to said landing, said spring face adapted to flex as said tab portion is rotated through said opening.

14. The package opening device of claim 13 wherein said spring face, said base portion, and said tab portion are integrally formed.

15. The package opening device of claim 13 wherein said spring face is connected to said landing by a first flexible joint.

16. The package opening device of claim 13 wherein said tab portion is connected to said spring face by a second flexible joint.

17. The package opening device of claim 13 wherein:

said spring face is connected to said landing by a first flexible joint; and said tab portion is connected to said spring face by a second flexible joint.

18. The package opening device of claim 13 further comprising an air vent.

19. The package opening device of claim 13 further comprising a lid hinged to said base portion, said lid adapted to be rotated about said base portion to cover said opening.

* * * * *